US005154320A

United States Patent [19]

Bolduc

[11] Patent Number: 5,154,320

[45] Date of Patent: Oct. 13, 1992

[54] AEROSOL SPRAY SYSTEM

[75] Inventor: Lee R. Bolduc, Raleigh, N.C.

[73] Assignee: Tri-Point Medical L.P., Raleigh, N.C.

[21] Appl. No.: 49,361

[22] Filed: May 14, 1987

Related U.S. Application Data

[63] Continuation of Ser. No. 812,237, Dec. 23, 1985, abandoned.

[51] Int. Cl.[5] ..... B67D 5/60

[52] U.S. Cl. ..... 222/145; 222/394; 604/87

[58] Field of Search ..... 222/145, 192, 399, 130, 222/80, 87, 129, 136, 399, 394, 81; 604/87, 82, 56, 145, 244; 206/535, 532, 540, 528, 220; 169/83; 239/304

[56] References Cited

U.S. PATENT DOCUMENTS

| | | | |
|---|---|---|---|
| 1,587,598 | 6/1926 | Magg | 169/83 |
| 1,779,959 | 10/1930 | Bellocchio | 169/83 |
| 3,080,094 | 3/1963 | Modderno | 222/82 |
| 3,240,403 | 3/1966 | Modderno | 222/399 |
| 3,491,916 | 1/1970 | Graham | 222/80 |
| 3,591,089 | 7/1971 | Cronan | 239/304 |
| 3,648,899 | 3/1972 | Lukesch | 222/136 X |
| 3,718,235 | 2/1973 | Cronan | 222/145 |
| 3,773,264 | 11/1973 | Cronan | 222/145 X |
| 4,121,772 | 10/1978 | Cronan | 239/304 |
| 4,201,316 | 5/1980 | Klingaman | 222/80 |

OTHER PUBLICATIONS

"A New Aerosol Package"; *Aerosol Age;* Apr. 1986, pp. 40, 41 and 69.

*Primary Examiner*—Gregory L. Huson
*Attorney, Agent, or Firm*—Vidas & Arrett

[57] ABSTRACT

An aerosol dispensing device provides increased shelf life for aerosols containing unstable ingredients or reactive compounds. The device includes a container and a valve which, upon actuation of an actuator, has a portion which is depressed downwardly into the container. In some forms of the invention, the downward depression is exerted directly against a glass ampule containing a composition to be isolated from the container contents or valve mechanism. Such depression causes the ampule to break releasing its components where they may mix within the container. In another form of the invention, depression of the actuator causes a relatively heavy ball to be released into the container generally where it may contact and break a frangible liquid containing ampule within the container. The device of the invention provides physical separation of components within the ampule from components generally within the container until the first depression of the acuator.

5 Claims, 1 Drawing Sheet

AEROSOL SPRAY SYSTEM

This is a continuation of application Ser. No. 812,237, filed Dec. 23, 1985 and now abandoned.

FIELD OF THE INVENTION

The present invention relates to an aerosol dispensing device and, more particularly, to devices for providing an aerosol composition which separates unstable ingredients.

BACKGROUND OF THE INVENTION

An aerosol is a colloidal system consisting of very finely divided liquid or solid particles dispersed in and surrounded by gas. Aerosol dispensers typically include a pressurized container made of metal or glass which is provided with a discharge valve. The container is filled with a product to be sprayed with the propellant gas under pressure. The product that is to be dispersed as an aerosol may have the liquified propellant mixed with it in the form of a solution or the propellant may be present as a separate aqueous phase in the dispenser.

A wide variety of compositions would be highly useful if they could be dispersed from an aerosol container. However, many compositions have a relatively short shelf life due to polymerization or other reaction between individual chemicals of the composition. Also, some compositions contain chemicals which tend to destroy the gasket material of the valve mechanism which greatly limits the shelf life of aerosol containers filled with such compositions. Proper gasket selection may decrease stability problems in some cases but may present an added expense due to the alternative gasket material employed.

Some inventors have sought to avoid these probems by utilizing a aerosol can divided into two compartments. In Curry et al, U.S. Pat. No. 3,966,087 the product is dispensed from an aerosol can having two compartments connected by a gas valve. One compartment contains the product and the other contains propellant gas. However, in the device of that patent some of the material from the lower compartment is always present in the upper compartment.

Another mechanism to hold the reactants in common storage under non-reacting conditions within an aerosol container is described in U.S. Pat. No. 3,791,980. In that patent one of the ingredients is encapsulated in the form of drops in small protective shells. The shell prevents reaction between the reactants until ready for use at which time the reactants, including the coated droplets, are discharged through a single valve. The reactions actually mix outside of the aerosol container. This procedure is of course highly limited since it requires the formation of extremely small drops which must then be coated. The coated droplets must be kept separate from each other so as not to clump together to form a large aggregate.

BRIEF SUMMARY OF THE INVENTION

The device of the invention consists of the modified aerosol container into which at least one sealed ampule has been inserted. The ampules may contain a chemical or composition which should normally be separated from components generally within the interior of the container or those which are highly reactive to gasket material. In this manner, the filled aerosol spray device will have a greatly increased shelf life since little or no reaction may take place within the container due to the unique construction. When the mixed compositon is needed, the ampule within the container is merely broken to release its contents so as to mix with the propellant and other components within the container. Of course, once the ampules are broken the shelf life of the filled device will go down depending on the chemical properties of the mixture created.

The chemical containing ampules within the device are formed from a fragile substance such as glass. In the simplest form of the invention the ampules may be constructed and arranged such that shaking the device will cause the ampule to break when it conacts the wall of the container. While this may be suitable for some applications it will be unsuitable if the filled devices are to be shipped any distance since the handling involved could cause breakage of the ampules.

An alternative means to break the ampules would be to include one or more relatively heavy ball bearings within the container. The ampule could then be constructed such that a normal rolling movement of the ampule against the container walls or ball bearings would not cause the ampule to break but a violent shaking of the can would cause the ampules to be broken by contact with the rapidly moving, relatively heavy ball bearings.

In order to prevent accidental breakage of the ampule by the ball bearings, the ball bearings may be initially secured to a portion of the valve mechanism within the container until the actuator is depressed which would cause a release of the balls into the container. In this manner a ball bearing would not be able to contact the ampule until the end user depressed the valve mechanism for the first time.

The ampules of the invention may also be broken by a rod mechanism which extends from the valve actuater and stem downwardly into the container to a point where the rod entraps the ampule against the wall of the container without breaking. The pressure transmitted through the actuator and stem would then cause the rod to depress shattering the ampule between the wall of the container and the rod. This embodiment of the device would be less likely to cause premature undesired breakage of the ampules due to shipping and handling.

The unique aerosol containers of the invention allows one to employ an aerosol spray containing material such as cyanoacrylates. Cyanoacrylates tend to cause rapid deterioration of gasket materials and have heretofore had relatively short shelf lives in aerosol containers. Materials which generate heat or polymerize upon contact may be kept separated within the device of the invention until use is desired. With reactants such as epoxies, the device of the invention will provide a long shelf life until the ampule or ampules are broken, at which time the mixture must be used relatively quickly since the reactants will polymerize and solidify.

Nearly any application which would be desirable to apply in an aerosol form is now possible due to the device of the invention. Multiple ampules may be utilized with each containing segregated chemicals therewithin.

BRIEF DESCRIPTION OF THE DRAWINGS

A detailed description of the invention is hereafter described with specific reference being made to the drawings in which.

DETAILED DESCRIPTION OF THE INVENTION

Figure 1:
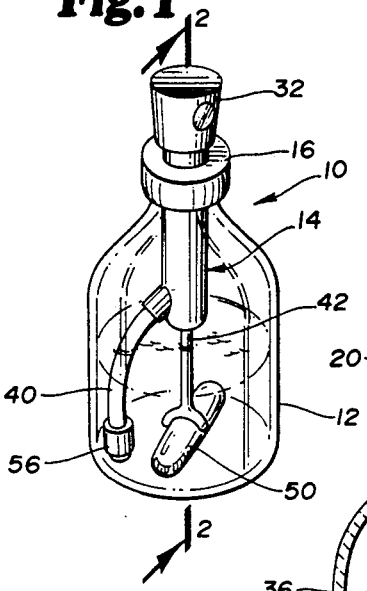
FIG. 1 is a perspective view of an aerosol spray device having a rod member which may break the ampule.

The aerosol spray device 10 shown in FIGS. 1-5 generally consists of a container 12 which is shown as a glass bottle. Spray device 10 includes an aerosol valve 14 which as shown as a ferrule type valve. Valve 14 includes a ferrule 16 which is attached to container 12 by a clinching operation whereby a skirt portion 18 of the ferrule 18 is tucked under the finish to form a seal between the container and a valve gasket 20 placed therebetween.

Figure 2:
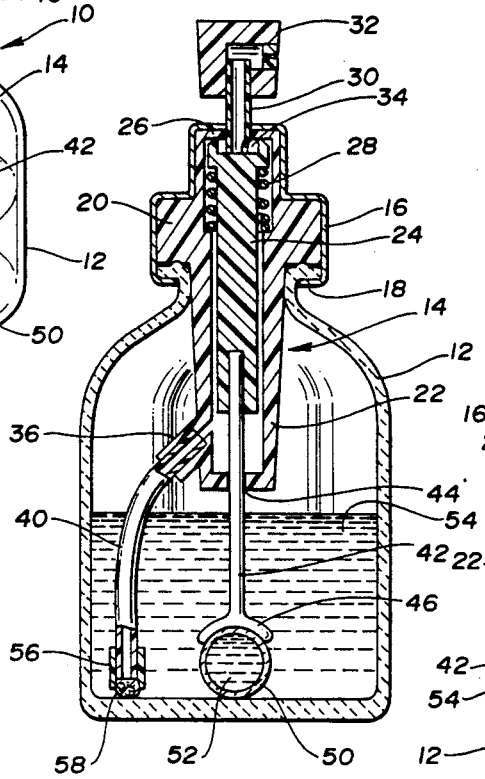
FIG. 2 is a cross-sectional view of the device of FIG. 1 taken along line 2—2 with the valve in a closed position.

Valve 14 further includes a valve body 22 which is typically formed from a plastic such as polyethlene. A valve stem 24 is positioned inside the cavity within valve body 22 as best shown in FIG. 2. Valve stem 24 is urged upwardly against stem gasket 26 by a compression spring 28. Valve stem 24 further includes a hollow tap 30 which extends beyond stem gasket 26 and ferrule 16 to provide an opening which extends outside of the bottle.

Aerosol valve 14 as shown in FIG. 2 is normally closed due to the presence of the compression spring 28. When an actuator or spray head 32 is positioned on top of tap 30 and depressed, it exposes tap orifice 34 to the interior chamber defined by valve body 22. Tap orifice 34 is now exposed to the interior of container 12 because valve stem 24 is no longer in contact with stem gasket 26.

Valve body 22 further includes a side opening 36 to which is attached a dip tube 40 through which propellant and other liquid under pressure may pass on its way through the valve and acuator 32.

Figure 3:
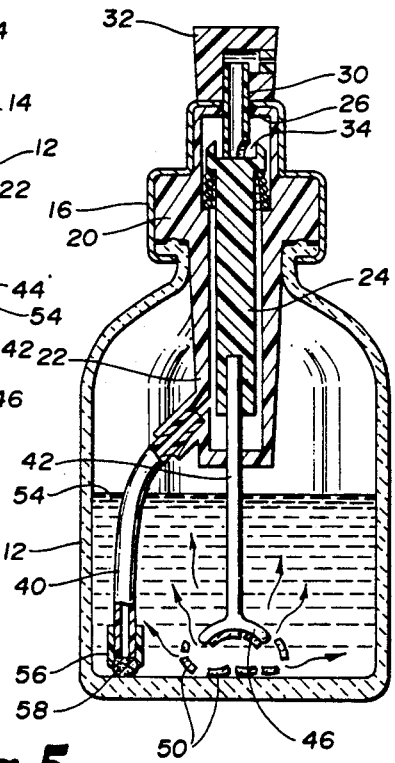
FIG. 3 is a cross-sectional view of the device of FIG. 1 with the valve opened showing the rod breaking an ampule.

In the embodiment shown in FIGS. 1-3 valve stem 24 includes a compression or breaker rod 42 which extends downwardly through an opening 44 in valve body 22 as shown. Preferably, opening 44 in valve body 22 is relatively tight fit with breaker rod 42 as such that the majority of flow into valve body 22 is through dip tube 40. Breaker rod 42 preferably includes a saddle shaped end or foot 46 which is constructed and arranged to partially encircle and trap against the bottom of container 12 a glass ampule 50.

Ampule 50 is preferably formed of glass or other frangible material and contains within its interior a second liquid 52. Liquid 52 would ordinarily be either unstable in the presence of liquid 54 which surrounds ampule 50 or would tend to cause a general deterioration of portions of the valve or seals if mixed generally with liquid 54. Liquid 54 may be propellant only or may include any number of chemicals. Likewise, liquid 52 may be a single compound or may be a mixture of compositions.

As shown in FIGS. 1-3 saddle shaped foot 46 will normally be in a position such that restrains ampule 50 from having free movement within container 12. Depression of actuator 32 causes saddle shaped foot 46 to provide a compressive force against ampule 50 between the foot and the bottom of container 12 causes the frangible ampule to break. The broken ampule then releases its contents generally into the first liquid 54 as shown schematically in FIG. 3 by means of arrows. Since ampule 50 is shattered by depression of actuator 32 since small fragments of ampule 50 may cause an obstruction within dip tube 40. Therefore, it is preferred to include a filter body 56 and a filter 58 at the end of dip tube 40 to screen out large particles of ampule 50 to prevent such particles from interfering with the operation of the valve 14.

In the device shown in FIGS. 1-3 unstable ingredients or reactive ingredients may be kept physically separated from either the liquid 54 or the valve seals until the first use of aerosol spray device 10. Saddle shaped foot 46 will operate both to gently restrain ampule 50 from violent movement within container 12 which might otherwise break the ampule and also to break the ampule when an operator depresses actuator 32 for the first time. The shelf life of an aerosol spray device 10 constructed as shown in FIGS. 1-3 is many magnitudes that which may be achieved by other constructions which utilize either reactive materials or unstable materials. In particular, liquid 52 may include a cyanoacrylate which would tend to polymerize rapidly after mixture with liquid 54 and would tend to deteriorate gaskets 20 and 26. By virture of the device of the invention it is now possible to realistically provide an aerosol spray of cyanoacrylates and other compositions which have heretofor had unacceptably short shelf lives.

Breaker foot 46 may be constructed and arranged such that it is capable of holding a plurality of separate discrete ampules 50 each of which contains a material which is reactive with the material within another ampule. In this manner a wide variety of compositions may be kept physically separated within an aerosol container.

Figure 4:
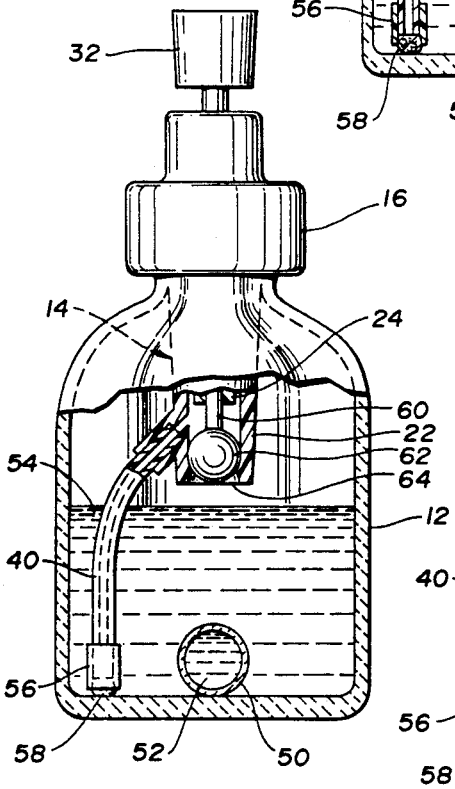
FIG. 4 is a side-elevational view of a spray device having a valve body which initially traps a metal ball therewithin with parts cutaway.
Figure 5:
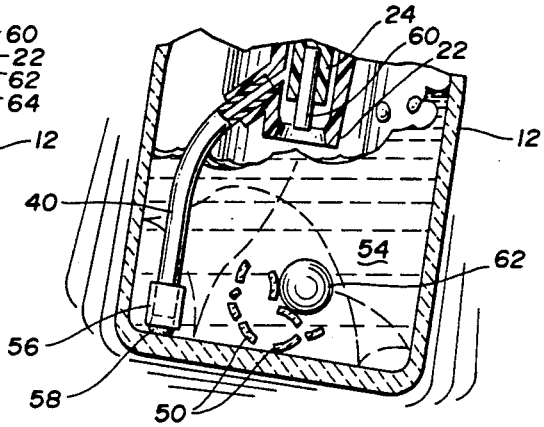
FIG. 5 is a partial side-elevational view of the device of FIG. 4 showing the valve in an open position which injects the ball into the container.

Aerosol spray device 10 shown in FIGS. 4 and 5 utilizes a similar ferrule type valve construction. However, instead of having a breaker rod 42 which normally extends beyond opening 44, it includes a stud 60 which in a closed valve position rests against a breaker ball 62 whose diameter is slightly greater than the diameter of opening 64 of valve body 22. Valve body 22 in the embodiment shown in FIGS. 4 and 5 has a degree of flexibility sufficient such that depression of actuator 32 will cause stud 60 to depress downwardly forcing breaker ball 62 through opening 64 and into container 12 generally. Breaker ball 62 is then able to contact and break ampule 50 within container 12 by shaking device 10 until breaker ball 62 contacts and breaks ampule 50. Breaker ball 62 may be a heavy metal, solid glass or nearly any generally inert body which is sufficiently hard and heavy enough to break ampule 50.

In the embodiment shown in FIGS. 4 and 5 ampule 50 may either be free within container 12 or it may be attached to container 12 by adhesive or the like to prevent accidental breakage caused by an ampule striking the wall of container 12. In order to reduce the likelihood that a free ampule would break by contacting container wall 12 before the breaker ball is expelled from valve body 22 the ampule may be formed from a slightly less frangible material. Alternatively, the walls of the ampule may be thicker in order to withstand breakage by a plastic glass contact. Also, since ampule 50 is generally quite light, even severe shaking of device 10 will not impart significant momentum to ampule 50 in comparison to liquid 54 such that a collision of ampule 50 against container 12 is likely to cause breakage. As described above for the embodiment shown in FIGS. 1-3, a plurality of ampules 50 may be included within container 12 of the embodiment of FIGS. 4 and 5 all of which may be broken by breaker ball 62 after it is expelled into a container.

Finally, breaker ball 62 as shown in FIGS. 4 and 5 may itself be an ampule which contains liquid. In that event ampule ball 62 may be either broken itself when stud 60 is depressed downwardly by actuation of the actuator or may be broken when it is fully expelled through opening 64. Alternatively, the ampule ball may contact and break against either the container ball or another ampule. In either event, the device shown in FIGS. 4 and 5 provides an aerosol device which is capable of dramatically prolonging the shelf life of aerosol compositions by providing a physical separation between chemicals and or portions of the valve mechanism.

In considering this invention it must be remembered that the disclosure is illustrative only and that the scope of the invention is to be determined only by the appended claims.

What is claimed is:

1. An aerosol dispensing device comprising:

a) a container for holding propellant and at least one component to be sprayed therefrom, said container including therewithin liquefied gas;

b) aerosol valve means for providing a pressure seal to said container and for providing a manual release of the propellant and components from said container, said valve means comprising an aerosol valve which includes an actuator, valve stem and a dip tube;

c) at least one frangible, sealed ampule positioned within said container, said ampule containing components being chemically separated from other components within said container until said ampule is broken, and d) means for breaking said ampule upon depression of said actuator, said means comprising a member constructed and arranged such that depression of said actuator causes a portion of said member to press against an ampule within said container so as to break said ampule, thereby releasing its contents to the container interior.

2. The device of claim 1 wherein said means for breaking ampule comprises a compression rod having one end in physical contact with said valve means such that depression of said actuator causes the free end of said rod to move toward the container wall.

3. The device of claim 2 wherein the free end of said rod includes ampule holding means for holding an ampule in a fixed position within said container such that movement of said free end of said rod towards the container wall causes an ampule held by said means to be crushed therebetween.

4. The device of claim 3 wherein said ampule holding means comprises a generally saddle-shaped member which is positionable over an ampule within said container such that said ampule cannot move to a position within said container in which depression of said rod would not break the ampule.

5. The device of claim 1 wherein said dip tube includes a filter means for preventing pieces of a broken ampule from interfering with the valve.

* * * * *